United States Patent [19]

Mosely

[11] Patent Number: 4,517,251

[45] Date of Patent: May 14, 1985

[54] BLANK FOR FOLDING AN OCTAHEDRON AND FOLDED PRODUCT

[76] Inventor: Jeannine Mosely, 48 Teel St., Arlington, Mass. 02174

[21] Appl. No.: 430,974

[22] Filed: Sep. 30, 1982

[51] Int. Cl.[3] ..... A47G 33/08; G09F 1/00

[52] U.S. Cl. ..... 428/542.8; 40/539; 52/DIG. 10; 428/12; 446/488

[58] Field of Search ..... 46/1 L; 428/542.8, 11, 428/12; 446/487, 488; 273/155; 52/DIG. 10; 434/403; 40/539

[56] References Cited

U.S. PATENT DOCUMENTS

| | | | |
|---|---|---|---|
| 2,633,657 | 4/1953 | Warren, Jr. | 428/7 |
| 3,093,461 | 6/1963 | Woolven | 428/12 |
| 3,267,597 | 8/1966 | Jannes | 428/12 X |
| 3,302,321 | 2/1967 | Walker | 428/12 X |
| 3,730,818 | 5/1973 | Salinari | 428/12 |
| 3,894,352 | 7/1975 | Hooker | 428/542.8 X |
| 4,021,950 | 5/1977 | Asija | 428/542.8 X |
| 4,145,850 | 3/1979 | Runyon | 52/DIG. 10 |
| 4,366,961 | 1/1983 | Busse | 273/155 |

*Primary Examiner*—Henry F. Epstein
*Attorney, Agent, or Firm*—Neal J. Mosely

[57] ABSTRACT

A blank of foldable sheet material for folding a regular octahedron comprises a sheet of foldable material, such as paper, plastic sheet or metal foil, having the shape of a regular hexagon, without interior cuts or exterior tabs. The blank is scored or marked for scoring along lines subdividing said hexagon into 24 equilateral triangles of equal size, each having sides one half the length of a side of said hexagon. The triangles are formed by first marking or scoring along lines extending from opposite apexes of the hexagon to produce six equilateral triangles having sides of the same length as the sides of the hexagon and then marking or scoring along lines connecting the midpoints of adjacent ones of the first produced triangles. Successive folding of apexes of the blank along score lines ending with the tucking of one final flap into another produces an octahedron held together by the folds and final tuck without need for adhesives or other securing means. The sheet of foldable material may a surface imprint or decorative coating on the portions thereof visable when folded into an octahedral shape and may have surface imprints comprising indicia and instructions for folding into an octahedral shape.

7 Claims, 13 Drawing Figures

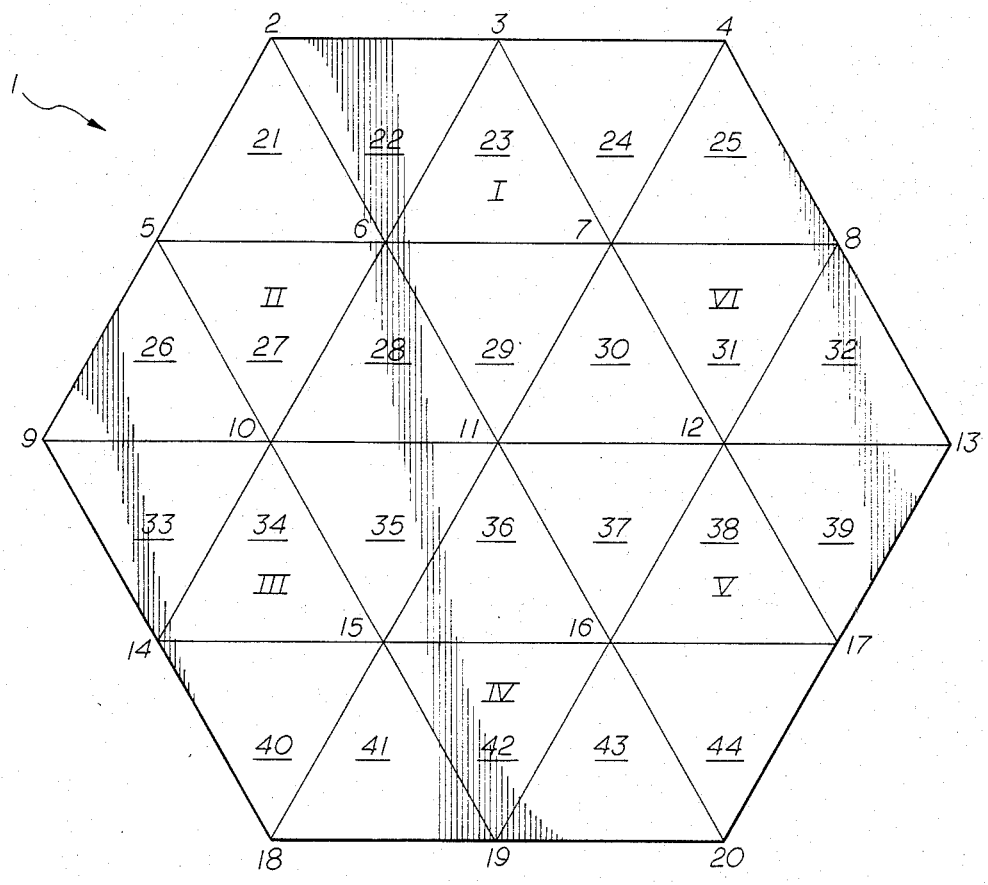
fig. 1
fig. 2
(FIRST FOLD)
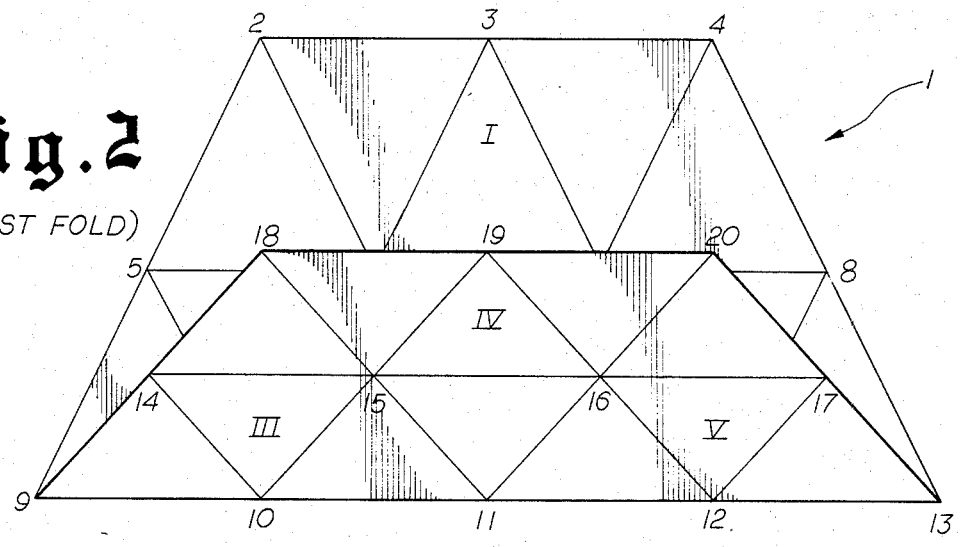

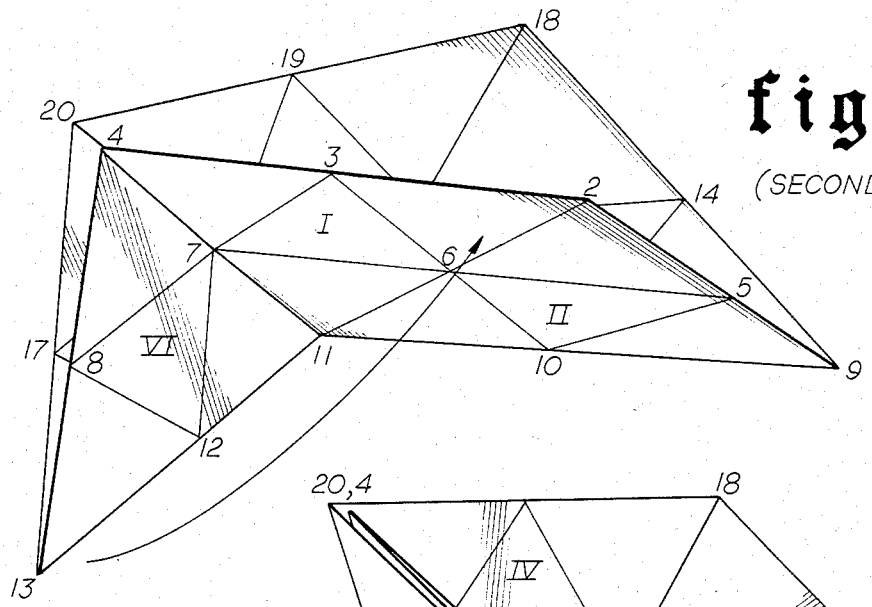
fig. 3 (SECOND FOLD)
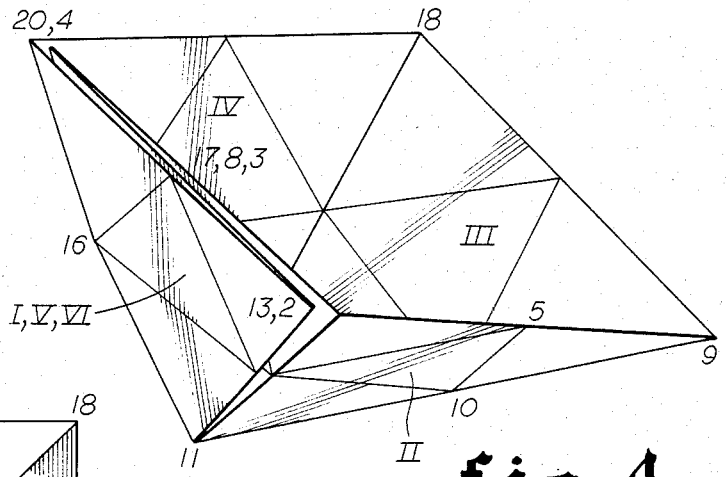
fig. 4 (OPEN PYRAMID)
fig. 5 (THIRD FOLD)
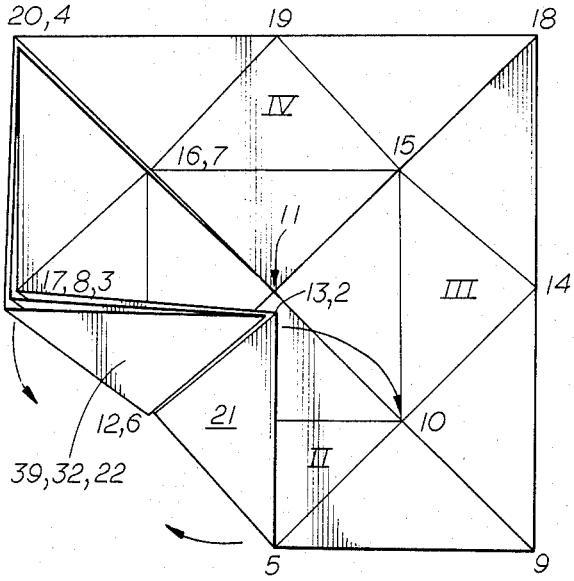
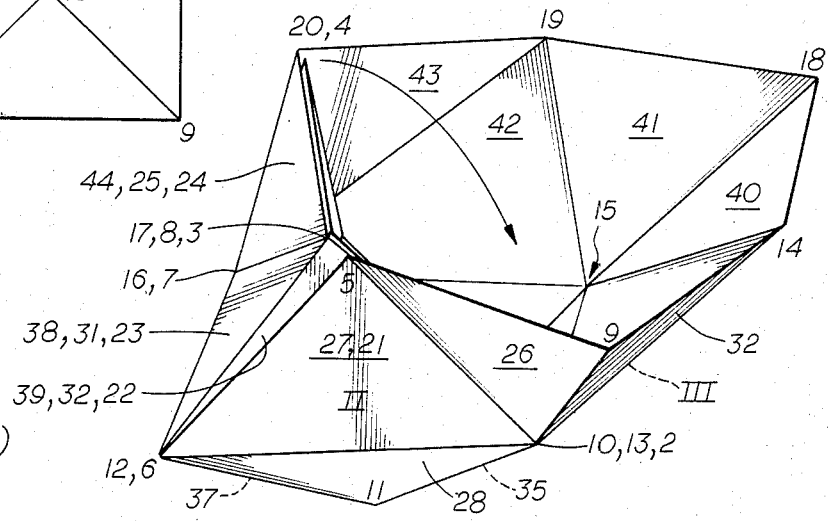
fig. 6 (FOURTH FOLD)

(FIFTH FOLD)

BLANK FOR FOLDING AN OCTAHEDRON AND FOLDED PRODUCT

BACKGROUND OF THE INVENTION

1. Field of the Invention

This invention relates to new and useful improvements in blanks for folding paper or other sheet material into decorative shapes and more particularly to blanks for folding a regular octahedron and to the product produced therefrom.

2. Description of the Prior Art

Warren U.S. Pat. No. 2,633,657 discloses an octahedral pyramidal ornament and a sheet material blank for folding the same.

Woolven U.S. Pat. No. 3,093,461 discloses a stellated ornament and a multiple part blank for folding the same.

Jannes U.S. Pat. No. 3,267,597 discloses a blank for folding a hollow display.

Walker U.S. Pat. No. 3,302,321 discloses a multi-part blank for folding into an ornament.

Salinari U.S. Pat. No. 3,730,818 discloses a two-part blank for folding an octahedral ornament.

SUMMARY OF THE INVENTION

One of the objects of this invention is to provide a new and improved blank for folding sheet material into a regular octahedral shape.

Another object of this invention is to provide a new and improved one-piece blank of compact, regular shape for folding sheet material into the shape of a regular octahedron.

Still another object of this invention is to provide an improved ornament or novelty item having the shape of a regular octahedron folded from a one-piece blank of compact regular shape.

Other objects of the invention will become apparent from time to time throughout the specification and claims as hereinafter related.

These and other objects of the invention are accomplished by a blank of foldable sheet material for folding a regular octahedron which comprises a sheet of foldable material, such as paper, plastic sheet or metal foil, having the shape of a regular hexagon, without interior cuts or exterior tabs.

The blank is scored or marked for scoring along lines subdividing said hexagon into 24 equilateral triangles of equal size, each having sides one half the length of a side of said hexagon. The triangles are formed by first marking or scoring along lines extending from opposite apexes of the hexagon to produce six equilateral triangles having sides of the same length as the sides of the hexagon and then marking or scoring along lines connecting the midpoints of adjacent ones of the first produced triangles.

Successive folding of apexes of the blank along score lines ending with the tucking of one final flap into another produces an octahedron held together by the folds and final tuck without need for adhesives or other securing means.

The sheet of foldable material may a surface imprint or decorative coating on the portions thereof visable when folded into an octahedral shape and may have surface imprints comprising indicia and instructions for folding into an octahedral shape.

BRIEF DESCRIPTION OF THE DRAWINGS

FIG. 1 is a plan view of a sheet material blank ruled or scored for folding into a regular octahedron.

FIG. 2 is a view of the blank shown in FIG. 1 after the first fold.

FIG. 3 is a view of the blank shown in FIGS. 1 and 2 after the second fold.

FIG. 4 is a view of the blank after the second fold and opened.

FIG. 5 is a view of the blank after the third fold.

FIG. 6 is a view of the blank after the fourth fold.

DESCRIPTION OF THE PREFERRED EMBODIMENT

Figure 7:
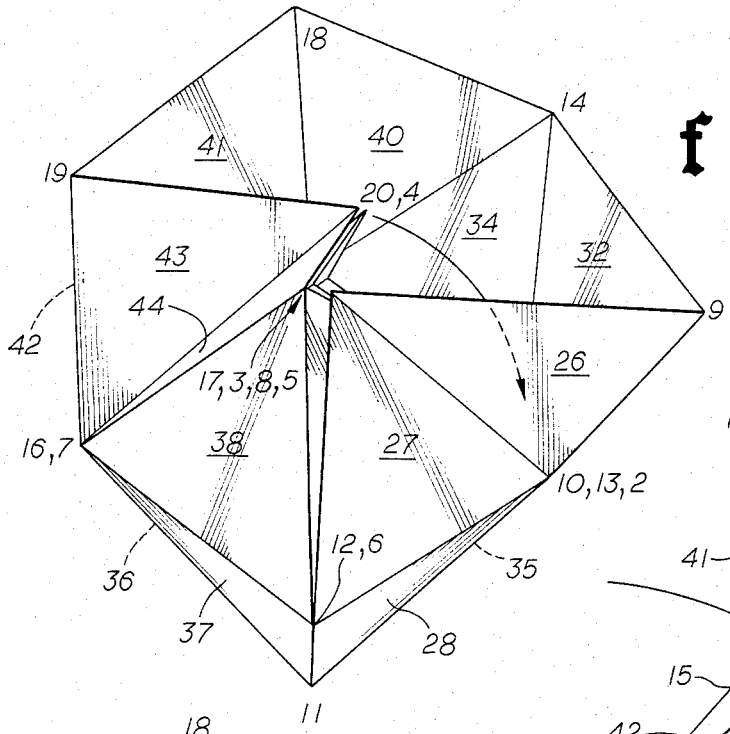
FIG. 7 is a view of the blank at the start of the fifth fold.

Referring to the drawings by numerals of reference and more particularly to FIG. 1, there is shown a sheet material blank which may be of paper, cardboard, sheet plastic, metal foil, or the like. Blank 1 is designed for folding into the shape of a regular octahedron. A regular octahedron, as it well known, is one of the classical regular solid shapes and has eight faces, all of which are equilaterial triangles of identical size.

Blank 1 is hexagonal in shape and is marked by lines for folding or is creased or scored for folding as indicated. In order to facilitate the description of the folding of blank 1 into a regular octahedron, the corners of the blank and the corners of all of the triangles which make up the blank are identified by reference numbers.

The six major triangles in the hexagon are numbered by Roman numerals from I to VI. The smaller triangles are given Arabic numeral references. In describing the folding of blank 1 into a regular octahedron, reference will be made to fold lines by the numerals of reference identifying the ends of those lines and to the larger triangles by their Roman numerals or the smaller triangles by their numerals of reference.

The corners or apexes of the hexagon and the triangles formed by the marked or scored fold lines are identified by numerals in sequence from 2 to 20. The major triangles which are formed by the lines extending diagonally across the hexagonal blank through the center of the blank are identified by roman numerals from I to VI.

The smaller triangles are numbered from 21 through 44, in sequence. These triangles have sides which are one-half the length of the side of the hexagonal blank 1. The length of the sides of the smaller triangles is the same as the length of a side or edge of the completely folded octahedron. Likewise, the smaller triangles, after folding, become the faces of the completely folded octahedron.

When the blank 1 is completely folded into an octahedron, triangles 26, 27, 28, 35, 36, 37, 38, and 42 will be the exposed faces of the octahedron. These faces are marked schematically (by surface shading) to show the presence of a decorative coating or indicia, such as printing, symbols, designs, or the like. These features are optional and facilitate the use of the completed object as an ornament, e.g. for a Christmas tree, or as a novelty item bearing a message, such as a greeting or carrying advertising material. The blank is preferably marked, at points which do not show in the finished product, with instructions for folding into an octahedron.

Figure 10:
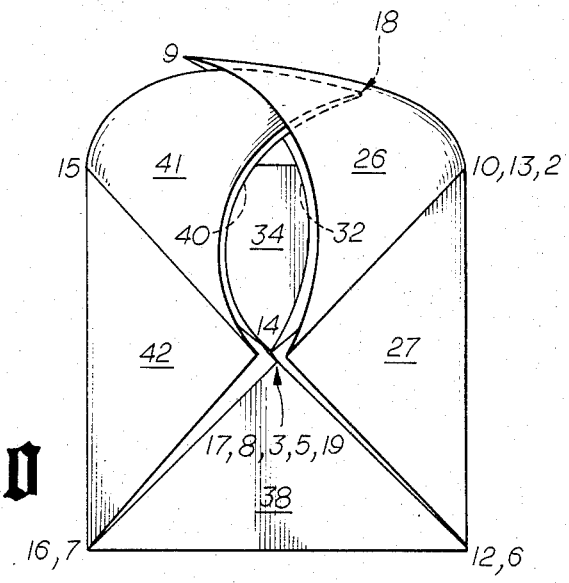
FIG. 10 is a view of the blank during the final tuck closing the octahedron.
Figure 11:
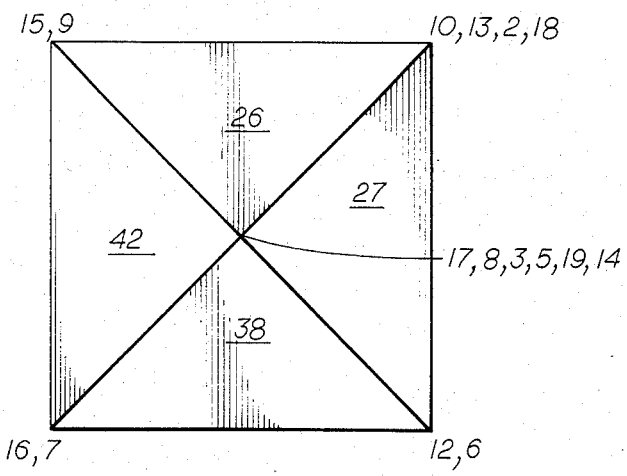
FIG. 11 is a view of the completed octahedron after the final tuck.
Figure 12:
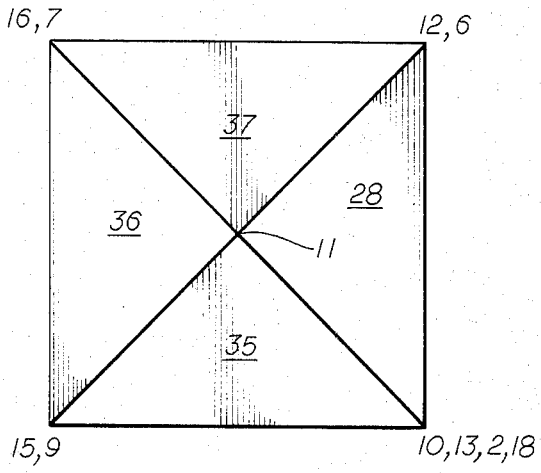
FIG. 12 is a view of the opposite side of the completed octahedron shown in FIG. 11.
Figure 13:
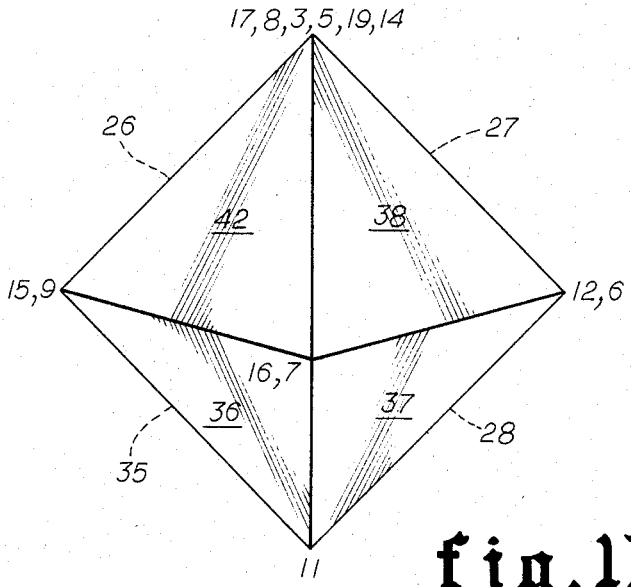
FIG. 13 is an isometric view of the completed octahedron.

The folding of blank 1 is shown successively in FIG. 2 to 10 and will be described. Figs. 11–13 show the completely folded octahedron. The first fold of blank 1 is along the diametrically extending line 9-13, as shown in FIG. 2. After being folded to the position shown in FIG. 2 and throughly creased, the blank is ready for the second fold.

The second fold is along lines 2-11, 4-11 and 13-11 which brings major triangles I and VI together, as seen in FIG. 3. When this fold is completed, major triangle VI is folded against major triangle V with corner or apex 4 being against corner or apex 20. Major triangle I is folded against major triangle VI with corner or apex 2 against corner or apex 13. At this point, with the fold held in the position just described, the blank is opened into a square pyramid, as shown in FIG. 4.

The third fold takes place from the opened pyramid shown in FIG. 4. The third fold is shown in FIG. 5 and consists of folding the corner consisting of apexes 2 and 13 inward along fold lines 17-2, 2-6, 5-6 and 17-6. This fold is completed by bringing the fold against the side wall where the folded triangles are brought against the inner side of triangle 38.

At this point, the folded blank is ready for the fourth fold which is shown in FIG. 6. Holding the blank with the folds in position, triangles 43 and 44 are folded inward along line 16-20 and lines 15-16 and 16-17. This fold brings triangles 43 and 44 into contact with corner 19 touching corner 17. At this point in the folding, the octahedral shape has begun to take form and only the open top remains to be folded in the fifth fold.

Figure 8:
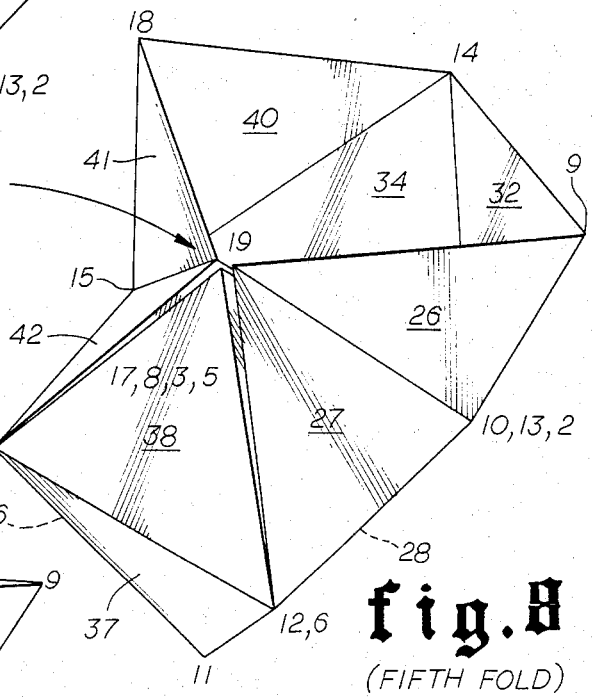
FIG. 8 is a view of the blank after the fifth fold.
Figure 9:
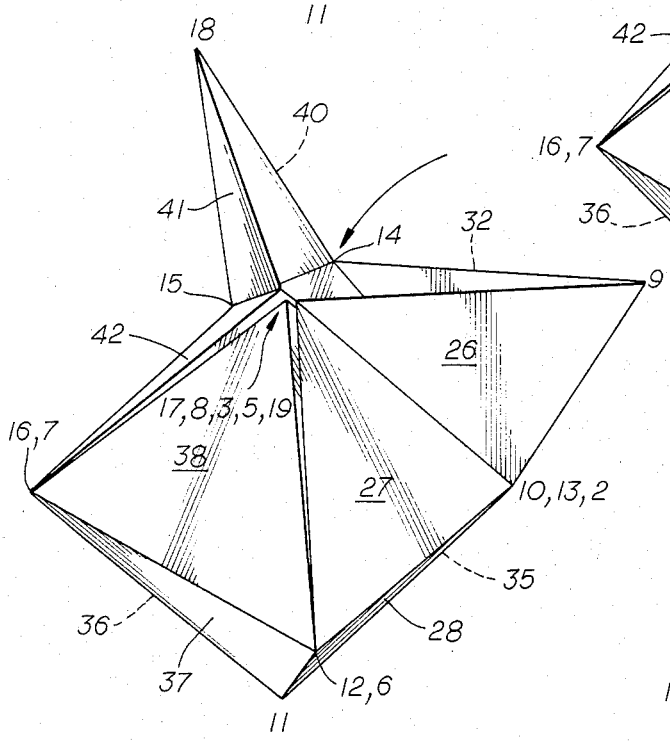
FIG. 9 is a view of the blank just prior to the final tuck.

The fifth fold is shown in FIGS. 8 and 9. While holding the previously folded flaps in the position described for the fourth fold, triangle 34 is pushed into a position closing the open top of the octahedron. In this position, apex or corner 14 is brought against corners 5, 17 and 19 which forms one of the corners of the completed octahedron.

At this point, there remain two loose flaps (see FIG. 9). One of the flaps consists of triangles 40 and 41 which are folded along line 15-18. The other flap consists of triangles 26 and 32 which are folded along line 9-10. At this point, the octahedron can be completed by tucking either of the flaps inside the other. For purposes of this description, the flap consisting of triangles 40 and 41 will be tucked inside the flap consisting of triangles 26 and 32 this flap when tucked in the manner indicated, as shown in FIG. 10, closes the opening of the octahedron and completes the fold.

The completed octahedron is shown in FIGS. 11-13. FIGS. 11 and 12 are views in elevation of opposite sides of the completed folded octahedron and FIG. 13 is a isometric view of the octahedron. The exposed faces of the completely folded octahedron are identified by reference numerals to show where the decorative coating or indicia will appear when they are included as part of the blank for folding.

This blank for folding into the shape of a regular octahedron differs substantially from blanks known in the prior art for folding this shape. Prior art blanks for folding an octahedron often are made in two parts or, if they are made in one part, require internal cuts in the blank with tabs formed for securing the blank together by adhesive or by other securing means. The blank which has been described above and the method of folding the blank into a completed octahedron does not require the use of adhesive or other securing means.

The corners of the completed octahedron are not open to the interior of the structure except at the point of the final fold and tucking of the last two flaps together. If desired, any suitable hanging device can be inserted into the open top of octahedron before the final flaps are tucked together which will permit the hanging of the completely folded octahedron as a Christmas tree ornament or the like.

The sequence of folds described above is more or less critical to the production of an octahedron from the blank as shown and described. Some minor variations are permissible, as for example, the holding of a folded flap on any given fold may be against either of two faces of the folded structure. Also, in the final step of closing the octahedron, there is a choice of which of the flaps is inserted in the other.

I claim:

1. A blank of foldable sheet material for folding a regular octahedron comprising a sheet of foldable material having the shape of a regular hexagon, without interior cuts or exterior tabs scored or marked for scoring along lines subdividing said hexagon into exactly 24 areas of equal size and shape comprising 24 equilateral triangles of equal size, each having sides one half the length of a side of said hexagon.

2. A blank according to claim 1 in which said triangles are formed by first marking or scoring along lines extending from opposite apexes of said hexagon to produce six equilateral triangles having sides of the same length as the sides of said hexagon, and then marking or scoring along lines connecting the midpoints of adjacent ones of the first produced triangles.

3. A blank according to claim 1 in which said sheet of foldable material has a surface imprint or decorative coating on at least the portions thereof visable when folded into an ocathedral shape.

4. A blank according to claim 1 in which said sheet of foldable material has surface imprints comprising indicia and instructions for folding into an octahedral shape.

5. A blank according to claim 1 in which said sheet material is paper, plastic sheet or metal foil.

6. A hollow object having the shape of a regular octahedron folded from a blank as defined in claims 1, 2, 3, 4 or 5, secured together by tucks and folds without need for adhesives or other securing means.

7. A hollow product having the shape of a regular ocetahedron of foldable sheet material folded from a one-piece blank having the shape of a regular hexagon subdivided into 24 equiliateral triangles of equal size, without interior cuts or exterior tabs, said octahedron having sides of a length equal to one half the length of a side of said hexagonal blank, and secured together in octahedral shape by folds and tucks in said sheet material without need for adhesives or other securing means.

* * * * *